United States Patent [19]

Wheelock

[11] 4,170,917

[45] Oct. 16, 1979

[54] MIRROR ACCESSORY MEANS FOR STRINGED MUSICAL INSTRUMENT

[76] Inventor: Daniel C. Wheelock, Rte. #3, Cheboygan, Mich. 49721

[21] Appl. No.: 835,175

[22] Filed: Sep. 21, 1977

[51] Int. Cl.[2] ..... G10D 3/04

[52] U.S. Cl. ..... 84/319; 84/312 P; 84/477 R; 84/485 R

[58] Field of Search ..... 84/312 P, 319, 453, 84/465, 470, 477 R, 485

[56] References Cited

U.S. PATENT DOCUMENTS

| | | | |
|---|---|---|---|
| 793,247 | 6/1905 | Thomas | 84/177 |
| 1,593,809 | 7/1926 | Vana | 84/319 |
| 2,650,513 | 9/1953 | Miller | 84/319 |
| 3,293,976 | 12/1966 | Windows | 84/453 |
| 3,379,088 | 4/1968 | Fox | 84/485 |
| 3,978,756 | 9/1976 | Feldman | 84/470 |

*Primary Examiner*—Lawrence R. Franklin
*Attorney, Agent, or Firm*—Lon H. Romanski

[57] ABSTRACT

In one embodiment a musical instrument, having a plurality of strings, a plurality of frets situated transverse to the strings and playable as with a cylindrical steel bar member slidably positionable along and against said strings, has an elongated mirror positioned generally parallel to the strings and generally perpendicular to the frets as to provide a visual indication to the player as to how accurately the player has positioned the steel bar member with respect to a selected fret; in another embodiment of the invention, the steel bar member itself carries a mirror surface thereby enabling the said elongated mirror to be dispensed with.

14 Claims, 10 Drawing Figures

MIRROR ACCESSORY MEANS FOR STRINGED MUSICAL INSTRUMENT

BACKGROUND OF THE INVENTION

Generally, in the field of guitars there is a class of guitars commonly referred to as "steel guitars." This class comprises a neck-like body with a bridge at one end thereof and a plurality of adjustment screws at the other end thereof with a corresponding number of musical strings or wires generally stretched therebetween. The neck-like body is also provided with a plurality of frets situated transversely thereof and spaced from each other in the manner well known in the art. The frets are of a height as to have the respective tops thereof substantially below the musical strings or wires which are, in turn, operatively connected to electrical tone producing and amplification means, as is also well known in the art. The instrument is played by holding the cylindrical steel bar generally transversely to the musical strings while sliding such bar therealong to chosen or selected positions corresponding to a selected fret. It should be made clear that the steel bar when thusly employed does in fact rest across all of the musical strings and that the resulting tonal quality is, in effect, a blend of the tonal quality of each of the musical strings, in turn, determined by the relative point of contact as between the steel bar and the particular string under consideration. Also, it should be pointed out that in such steel guitars, the musical strings do not touch the respective frets as the steel bar is employed in playing the instrument but rather such musical strings continue to maintain a spaced relationship relative to the tops of the frets. This is unlike, for example, a classical guitar where the player, with the fingers of one hand, actually depresses selected strings against selected frets in order to obtain the desired effective vibrating length of such string and the corresponding tonal quality therefrom.

As should be apparent, the correct tonal quality obtained from such a steel guitar played with a cylindrical steel bar depends on the accuracy of location of such steel bar by the player. That is, ideally, the steel bar should be placed against the musical strings or wires as to be directly above and in alignment with the particular fret, selected by the player, in order to obtain the "purest" or most pleasing tonal quality. However, because the steel bar is cylindrical and therefore touches the strings or wires only tangentially, it is impossible to visually select fret positions and, heretofore, the player would often position such steel slide bar off to one side of the related fret or position it to be relatively skew to such fret. Consequently, the resulting tonal quality was less than desirable. Heretofore, the prior art has failed to provide any satisfactory visual means for assisting the player in properly positioning the steel bar, during actual playing, and assure proper tonal quality.

Accordingly, the invention as herein disclosed and claimed is primarily directed to the solution of such and other attendant and related problems.

SUMMARY OF THE INVENTION

According to the invention, mirror means is provided whereby the image of the steel bar and the image of the exact physical location and position of the steel bar relative to the associated fret carried by an associated musical instrument are reflected to the player for visual observation thereof.

Various general and specific objects, advantages and aspects of the invention will become apparent when reference is made to the following detailed description considered in conjunction with the accompanying drawings.

BRIEF DESCRIPTION OF THE DRAWINGS

In the drawings, wherein for purposes of clarity certain details and/or elements may be omitted from one or more views.

DETAILED DESCRIPTION OF THE PREFERRED EMBODIMENT

Figure 1:
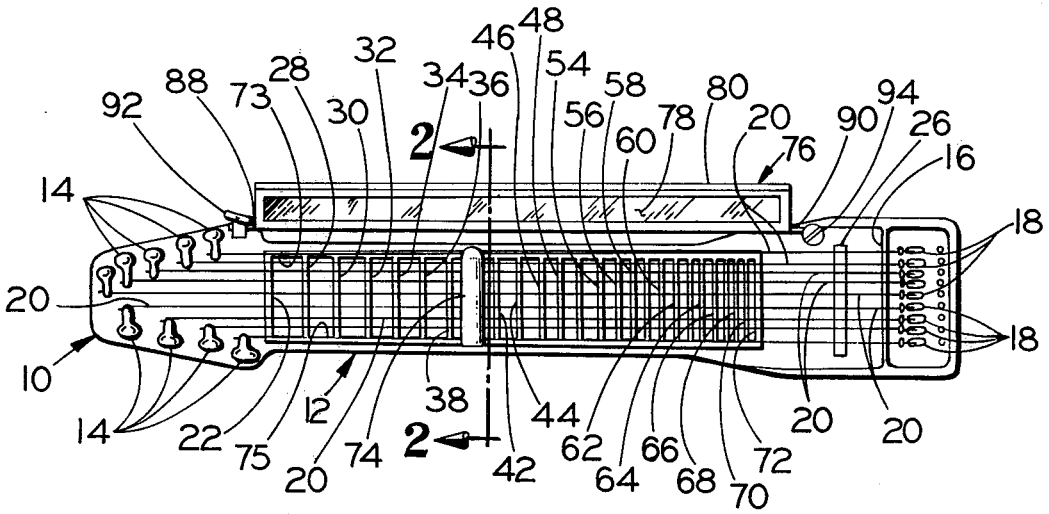
FIG. 1 is a top plan view of a typically illustrated steel guitar employing apparatus embodying teachings of the invention.

Referring now in greater detail to the drawings, FIG. 1 illustrates, in somewhat simplified form, a steel guitar 10 having a neck body portion 12 with a plurality of string tensioning devices 14, at the left end thereof, and a string anchor device 16, at the right end thereof, provided as is well known in the art with a plurality of slot-like apertures 18 for receiving therein the ends of the respective strings 20. A nut 22 is provided as at the left end of the neck body and leading to the string tensioning devices 14 as to thereby provide a plurality of spaced grooves for respectively receiving the strings 20 therein and thereby establishing and maintaining string spacing at that end. Bridge member 26 is an electrical pickup microphone while apertures 18 maintain string spacing.

As also shown, the neck body portion 12 is provided with a plurality of frets 28, 30, 32, 34, 36, 38, 40, 42, 44, 46, 48, 50, 52, 54, 56, 58, 60, 62, 64, 66, 68, 70 and 72 with with fret 40 being located directly underneath the slide bar 74 shown resting atop the strings 20. Further, in the embodiment disclosed, the neck portion is provided with upwardly directed generally longitudinally extending side rail-like portions 73 and 75 which join at and with the opposite ends of the respective frets.

Figure 2:
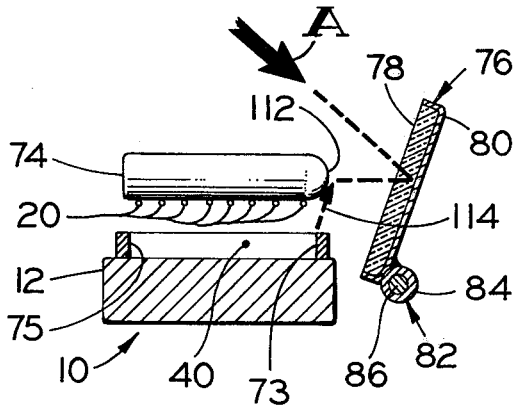
FIG. 2 is a slightly enlarged cross-sectional view taken generally on the plane of line 2—2 of FIG. 1 and looking in the direction of the arrows.

If it is assumed that the lower side (lower in FIG. 1) of the neck body portion is the side of the instrument from which the player plays the instrument 10, then, opposite such player's side is provided mirror means 76 which may be comprised of mirror or reflecting means 78 carried as within a frame and backing member 80 (also see FIG. 2).

As best seen in FIG. 2, the mirror or reflector means 76 is provided with hinging means 82 comprised as of a longitudinally extending tubular member 84, suitably secured to the backing member 80, as for example, by soldering or the like, and rod-like pivot and support means 86 closely received therethrough and having opposite end portions 88 and 90. As generally depicted in FIG. 1, rod end portion 88 may be retained to the guitar body as by suitable clamping or retainer means 92, while the rod end portion 90 may terminate as in a loop or hook configuration which receives therethrough suitable anchoring means such as a screw 94 threadably engaged with the right end portion of the guitar body.

Preferably, the rod 86 and tubular member are such as to exhibit some significant degree of frictional resistance to any relative angular rotation therebetween. As should be apparent, this may be accomplished in many different ways among which is employing, for example, a rod which is of significantly smaller cross-sectional diameter than the passage through the tubular member and then bowing or bending the rod so that it, at several points along its length, frictionally and resiliently contacts the juxtaposed internal surface areas of the tubular member.

In any event, the reflector means 76 may be pivotally adjusted generally about the effective pivotal axis of the pivot support means 82 as to thereby present the viewing surface of the reflector means in a position most favorable to the player.

Figure 9:
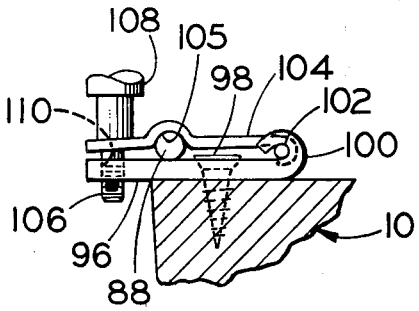
FIG. 9 is a fragmentary elevational view, with a portion of the related structure in section and cross-hatched, of the securing means of FIG. 8 taken generally in the direction of arrow B of FIG. 8.
Figure 8:
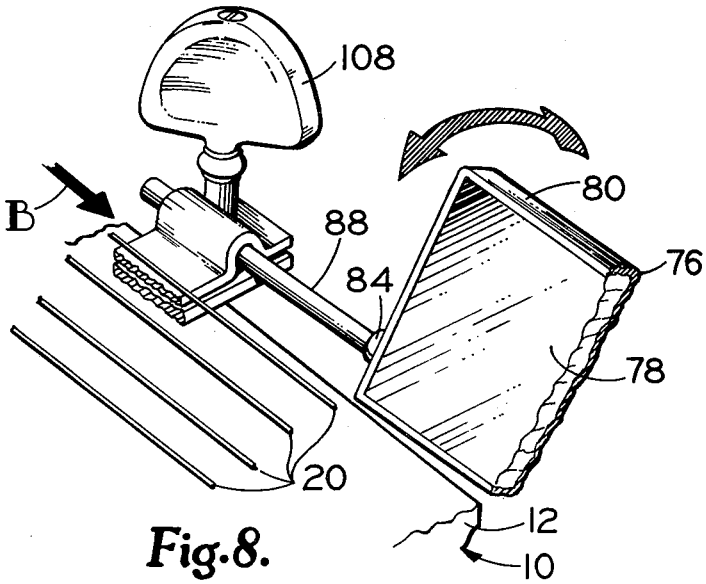
FIG. 8 is a partial enlarged perspective view of a portion of the structure of FIG. 1 fragmentarily illustrating one means for detachably securing the mirror means as to the remaining structure defining the steel guitar.

As generally depicted in FIGS. 8 and 9, end 88 of rod 86 may be retained as by releasable clamping means 92 comprising a base portion 96 suitably retained as by screw means 98 to the body of guitar 10 and having a first end curled as at 100 to retain a pivot or hinge pin 102. A second clamping plate 104 is similarly pivotally connected to the hinge pin 102 and is provided with a formed groove-like portion 105 for receiving end portion 88 of rod 86. The opposite end of plate 104 has an aperture formed therethrough for freely receiving a threaded portion 106 of a thumb screw member 108. The base plate 96 has an aligned aperture 110 which is threadably engaged by threaded portion 106. Accordingly, end portion 88 of rod 86 may be retained, as depicted merely by placing it in the position illustrated and tightening the clamping plate 104 downwardly against base plate 96 through use of the thumb screw 108.

As can be seen, in the preferred embodiment the slide bar 74 has a spherical end 112 which is, when played, pointing in the direction of the reflector means 76. As is well known in the art, such slide bars 74 are highly polished and often plated as with chrome or the like. It has been discovered that the polished suface of such slide bar 74, especially the spherical end surface 112, itself acts as, what may be referred to, a primary reflector or mirror surface. More specifically, it has been discovered that light impinging upon the frets (and side rail 73 of such comprises a portion of the guitar 10) is directed upwardly generally against the lower portion of the spherical end surface 112 of slide bar 74, generally as depicted by the arrows 114, thereby appearing as an image pattern thereon. Such image is then further directed against the mirror or reflector means 76 forming a secondary image thereon which, in turn, may be viewed by the player when looking in a direction as generally depicted by arrow A.

For purposes of discussion, let it be assumed that the slide bar 74 of FIGS. 1 and 2 is directly above fret 40 so that the medial vertical plane of such fret 40 passes through the axis of slide bar 74. In such an assumed condition, the player would observe, in the mirror means 76, a primary image of the slide bar 74 and a secondary image of the fret pattern appearing on the lower portion of spherical end 112 of slide bar 74. What the player would thusly see is generally depicted, in relatively enlarged scale, in FIG. 3 which is, in effect a fragmentary portion of the mirror or reflector 78.

Figure 3:
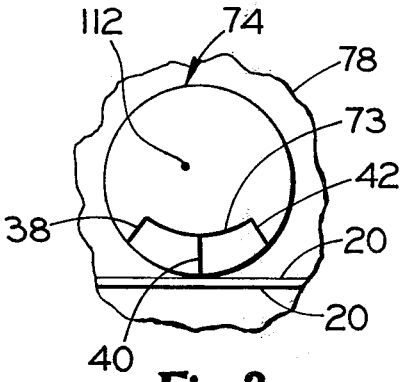
FIG. 3 is a relatively enlarged fragmentary view of the reflection seen in the mirror means of FIGS. 1 and 2 when viewed generally in the direction of the arrow A in FIG. 2 and with the steel bar in a first assumed operating position.

That is, referring to FIG. 3, the player would see the image of slide bar 74, in particular the forward or spherical end 112, in the mirror 78. Also, the player would see the secondary reflection of the fret 40, centered, and frets 38 and 42 at either side thereof. Further, if the guitar is of the type employing side rails, a portion of rail 73 would also be seen. Also, primarily depending on the relative angle of mirror 78 and the relative angle of viewing, one or more strings 20 would also be reflectively seen. In such an assumed condition, the image of fret 40 will be exactly vertically disposed and, if one or more strings 20 are also reflected, the strings will appear as touching the lower end of the fret 40 image while being tangentially disposed with respect to slide bar 74. Obviously, the image portions of frets 38 and 42 will appear inclined toward each other and if respective planes were passed through such image portions such planes would also respectively pass through the actual frets 38 and 42 disposed on either side of fret 40. Accordingly, when a player sees such an image pattern, and more specifically a vertically extending image pattern of fret 40, the player assuredly knows that he has properly positioned the slide bar directly over the selected fret (in this case assumed to be fret 40) and that the resulting tonal quality therefrom will be proper.

Figure 4:
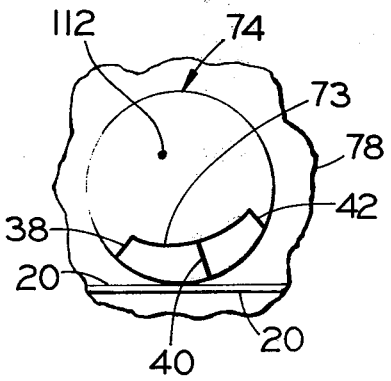
FIG. 4 is a view similar to that of FIG. 3 and illustrating the said reflection when the steel bar is in a second assumed operating position.

Now, still for purposes of discussion, let it be assumed that instead of being positioned directly over fret 40, the slide bar 74 has been positioned some slight amount to the left (as viewed in FIG. 1) of fret 40 and towards fret 38. Referring to FIG. 4 in this assumed condition, the player would see the image of fret 40 as being somewhat inclined from the vertical and also see the image of fret 42 somewhat elevated while the image of fret 38 would be seen as lowered (compared to FIG. 3). If the strings 20 were seen, such would appear as being generally tangential to the slide bar 74 but not touching the image of fret 40. When the player sees a reflective image as generally depicted in FIG. 4, the player then knows that he has misplaced the slide bar 74 to the left of the assumed selected fret 40 and can correct the position by moving the slide bar 74 back to the right until a reflective image pattern as depicted in FIG. 3 is attained.

Figure 5:
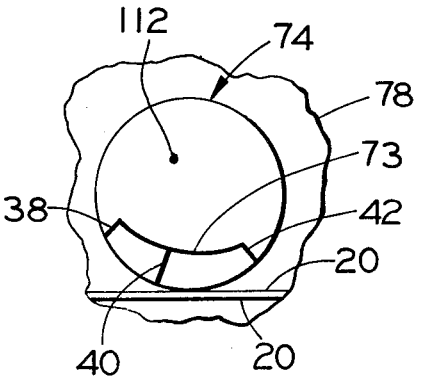
FIG. 5 is a view similar to that of FIGS. 3 and 4 and illustrating the said reflection when the steel bar is in a third assumed operating position.

Now let it be assumed that instead of being positioned directly over fret 40, the slide bar 74 has been positioned some slight amount to the right (as viewed in FIG. 1) of fret 40 and towards fret 42. Referring to FIG. 5, in this assumed condition, the player would see the image of fret 40 as being somewhat inclined from the vertical (in a direction of inclination generally opposite to that of FIG. 4) and also see the image of fret 38 somewhat elevated while the image of fret 42 would be seen lowered (as compared to either FIGS. 3 or 4). If the strings 20 were seen, such would appear as being generally tangential to the slide bar 74 but not apparently touching the image of fret 40. When the player sees a reflective image as generally depicted in FIG. 5, the player then knows that he has misplaced the slide bar 74 to the right of the assumed selected fret 40 and can correct the position by moving the slide bar 74 back to the left until a reflective image pattern as depicted in FIG. 3 is attained.

It should be apparent that image patterns as generally depicted in FIGS. 4 and 5 also result when the slide bar 74 is placed in a skew position relative to the selected fret.

Figure 7:
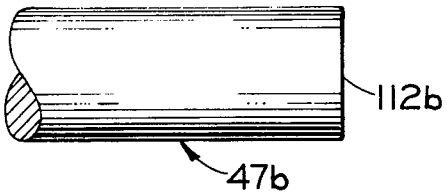
FIG. 7 is a fragmentary side elevational view of another modified form of a steel bar employable in practicing the teachings of the invention.
Figure 6:
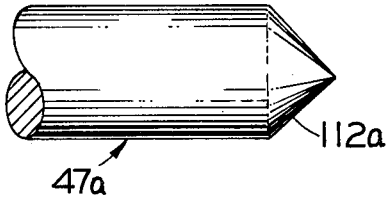
FIG. 6 is a fragmentary side elevational view of a modified form of a steel bar employable in practicing the teachings of the invention.

Through experimentation, it has also been discovered that other configurations of slide bars may be employed in practicing the invention. For example, FIGS. 6 and 7 respectively illustrate slide bars 47*a* and 47*b* which, in turn, have respective end surfaces 112*a* and 112*b*. As will be noted, end surface 112*a* is generally of conical configuraton while end surface 112*b* is of a flat planar configuration as contrasted to functionally similar end surface 12 of slide bar 74.

Figure 10:
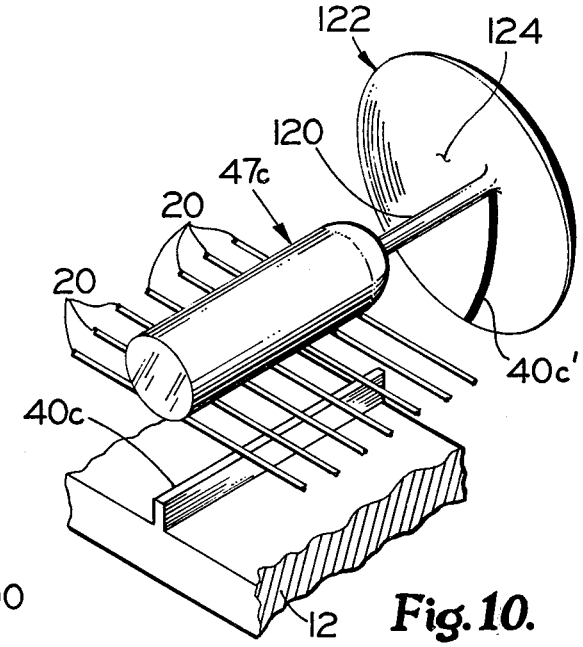
FIG. 10 is a perspective view of an other embodiment of the invention shown in playing position with a fragmentary portion of an associated steel guitar.

FIG. 10 illustrates another embodiment of the invention wherein the mirror or reflector means is mobil generally along the length of the strings 20. That is, in the embodiment of FIG. 10, which for purposes of reference illustrates in perspective a fragmentary portion of a guitar neck body 12 and a fret, as 40*c*, a slide bar 47*c* is shown as having an axially extending relatively narrow support extension 120 which, in turn, carries mirror or reflector means 122 at the extended end thereof. Although the mirror or reflector means 122 may be of any selected configuration, the specific embodiment disclosed comprises a mirror or reflecting surface 124 which is of generally concave configuration.

In the embodiment of FIG. 10, it then becomes possible to practice the invention without the need of stationary mirror means, such as 76, in that the mirror means 122 continually moves with the slide bar in order to thereby provide a field of reflected vision of sufficient area always in the position determined by and corresponding to the location of the slide bar. As generally depicted, the selected fret 40*c* (of related fret board means) will be reflected as a generally vertically extending pattern 40*c*′ in the surface 124 of mirror means 122. This, of course, would correspond to a condition as discussed and described with reference to FIG. 3. Also, as should be apparent, if slide bar 47*c* should be positioned somewhat to the left of fret 40*c*, the fret reflection pattern will assume a position as generally depicted in and described with reference to FIG. 4 while if such slide bar 47*c* is positioned somewhat to the right of fret 40*c*, the fret reflection 40*c*′ will assume a position as generally depicted in and described with reference to FIG. 5. Further, it should be apparent that the mirror surface 124 could be in a generally conical configuration and that such conical configuration could be oriented as to have its apex portion more closely disposed toward slide bar 47*c* while the remaining portion of such conical configuration would, while generally radiating, extend axially away from slide bar 47*c*.

It should also be made clear that the invention as disclosed in FIG. 10 is not limited to the specific manner in which the mirror means 122 is operatively carried by slide bar 47*c*. This is, for example, it is also contemplated that instead of a single axially extending support 120, a single or plurality of generally diverging supports may be provided. Such other contemplated support means may, for example, take the form of a relatively narrow support member having one end secured to or carried by the slide bar 47*c*, as at the end thereof, and having an other end secured to the general periphery of the mirror means 122. Many other means of thusly operatively securing mirror means to the slide bar for corresponding movement therewith will become apparent to those skilled in the art in view of the teachings of the invention herein disclosed.

Although only a preferred embodiment and selected modifications of the invention have been disclosed and described, it is apparent that other embodiments and modifications of the invention are possible within the scope of the appended claims:

I claim:

1. For use in combination with a musical instrument having fret board means, a plurality of frets situated along said fret board means, a plurality of musical strings situated generally above said frets and extending generally longitudinally along said fret board means, and a slide bar for contacting said strings at points in relationship to selected frets during playing of said instrument, reflector means positionable along one side of said fret board means and said strings to provide visual assistance to a player of said musical instrument in placing said slide bar on said strings directly above and in alignment with a particular selected fret, whereby said slide bar comprises reflector surface means effective for reflecting the image of said particular selected fret which is situated underneath said slide bar against said reflector means, and whereby said reflector means reflects said image to said player thereby enabling said player to position said slide bar on said strings directly above and in said alignment with said particular selected fret.

2. The combination of claim 1 and further comprising mounting means for securing said reflector means to said musical instrument.

3. The combination of claim 2 wherein said mounting means comprises pivotal support means for enabling said reflector means to be selectively pivotally adjusted relative to said musical instrument, said pivot support means comprising a pivotal axis, and wherein said pivotal axis extends generally longitudinally along said fret board means and generally transversely to said frets.

4. The combination of claim 2 wherein said reflector means comprises a relatively elongated reflecting surface of a length generally extending along said fret board means as to reflect all of said frets.

5. The combination of claim 4 wherein said reflector means comprises a housing member, a mirror carried by said housing member, wherein said mounting means comprises pivotal support means opetatively connected to said housing member for enabling said housing member and said mirror to be selectively pivotally adjustable relative to said fret board means and said strings, said pivotal support means comprising a first pivot member secured to said housing member, and second pivot member adapted to be secured to said musical instrument.

6. The combination of claim 5 wherein said second pivot member is adapted to be detachably secured to said musical instrument.

7. The combination of claim 1 wherein said reflector surface means is effective for reflecting the image of said particular selected fret as well as reflecting the images of the next adjacent frets against said reflector means, and whereby said reflector means reflects said images of said next adjacent frets as to cause such to appear to the player to be inclined with respect to the image of said selected fret.

8. The combination of claim 1 wherein said slide bar is of substantially cylindrical configuration and has at least one end which defines at least partly a generally spherical surface, wherein said spherical surface comprises said reflector surface means, and wherein said reflector means is positioned generally juxtaposed to said one end when said slide bar is placed on said strings as during playing of said instrument.

9. The combination of claim 1 wherein said slide bar is of substantially cylindrical configuration and has at least one end which defines at least in part a generally conical surface, wherein said conical surface comprises said reflector surface means, and wherein said reflector means is positioned generally juxtaposed to said one end when said slide bar is placed on said strings as during playing of said instrument.

10. A slide bar for use in playing a stringed musical instrument having fret board means, a plurality of frets situated generally along said fret board means in spaced relationship, and a plurality of musical strings extending generally longitudinally of said fret board means and above said plurality of frets, said slide bar comprising a generally cylindrical slide bar body having first and second ends, and reflector means operatively carried by said slide bar body as to be generally juxtaposed to said first end and reflecting in a direction generally toward said first and second ends, said reflector means being effective when positioned on said strings by a player located generally juxtaposed to said second end to provide a visual indication by reflection to said player of the relative position of said slide bar body and a selected one of said frets.

11. A slide bar according to claim 10 wherein said reflector means comprises a generally concave reflecting surface.

12. A slide bar according to claim 10 and further comprising connecting means carried by said slide bar body and extending generally away from said first end as to carry thereon said reflector means at a distance generally axially spaced from said first end.

13. For use in combination with a musical instrument having fret board means, a plurality of frets situated along said fret board means, and a plurality of musical strings situated generally above said frets and extending generally longitudinally along said fret board means, reflector means positionable along one side of said fret board means and said strings to provide visual assistance to a player of said musical instrument in placing a slide bar on said strings directly above and in alignment with a particular fret, and further comprising connecting means for interconnecting said reflector means to said slide bar as to thereby cause said reflector means to continually assume positions dictated and determined by the position of said slide bar.

14. The combination of claim 13 wherein said slide bar is of substantially cylindrical configuration and has at least one end which defines at least partly a spherical surface comprising reflector surface means, and wherein said reflector surface means is generally juxtaposed to said reflector means.

* * * * *

UNITED STATES PATENT AND TRADEMARK OFFICE

CERTIFICATE OF CORRECTION

PATENT NO. : 4,170,917

DATED : October 16, 1979

INVENTOR(S) : Daniel C. Wheelock

It is certified that error appears in the above-identified patent and that said Letters Patent are hereby corrected as shown below:

Column 2, line 67, immediately before "fret 40" delete "with";

Column 5, line 27, change "12" to --- 112 ---; and

Claim 5, line 4 thereof, change "opetatively" to --- operatively ---.

Signed and Sealed this

*Twenty-sixth* Day of *February 1980*

[SEAL]

*Attest:*

SIDNEY A. DIAMOND

*Attesting Officer*

*Commissioner of Patents and Trademarks*